US006577278B1

(12) United States Patent
Hood et al.

(10) Patent No.: US 6,577,278 B1
(45) Date of Patent: Jun. 10, 2003

(54) DUAL BAND ANTENNA WITH BENDING STRUCTURE

(75) Inventors: Chuck Hood, Austine, TX (US); Chung-Ta Cheng, Santa Clara, CA (US); Chih-Hsien Chou, San Jose, CA (US); Chien-Hsun Huang, Tu-Chen (TW)

(73) Assignees: Hon Hai Precision Ind. Co., Ltd., Taipei Hsien (TW); Dell Products, L.P., Round Rock, TX (US)

( * ) Notice: Subject to any disclaimer, the term of this patent is extended or adjusted under 35 U.S.C. 154(b) by 0 days.

(21) Appl. No.: 10/037,721

(22) Filed: Dec. 29, 2001

(51) Int. Cl.[7] ..... H01Q 1/38

(52) U.S. Cl. ..... 343/700 MS; 343/702; 343/846

(58) Field of Search ..... 343/700 MS, 702, 343/829, 830, 846, 848; H01Q 1/24, 1/32, 1/38

(56) References Cited

U.S. PATENT DOCUMENTS 5,668,560 A * 9/1997 Evans et al. ..... 343/702
6,100,850 A * 8/2000 Utsumi ..... 343/702
6,157,348 A * 12/2000 Openlander ..... 343/846
6,408,190 B1 * 6/2002 Ying ..... 455/553
6,414,641 B1 * 7/2002 Carlson et al. ..... 343/702
6,437,747 B1 * 8/2002 Stoiljkovic et al. ..... 343/702
6,466,170 B2 * 10/2002 Zhou ..... 343/700 MS
6,476,769 B1 * 11/2002 Lehtola ..... 343/702

* cited by examiner

*Primary Examiner*—Tho Phan
(74) *Attorney, Agent, or Firm*—Wei Te Chung

(57) ABSTRACT

A dual band antenna for an electronic device includes a ground patch (10) having a connecting portion (101) and a bending portion (102), a first radiating branch (11) transversely extending from the connecting portion, and a second radiating branch (12) partly surrounding the first radiating branch and including a connecting patch (121) extending from the connecting portion and a radiating patch (120) extending from the connecting patch. The connecting portion, the first radiating branch and the connecting patch are located in a same first plane. The bending portion and the radiating patch respectively bend at predetermined angles to the first plane to form a bending structure adapted for an irregular installation space in the electronic device.

18 Claims, 6 Drawing Sheets

Horizontally Polarized Principle Plane Radiation Pattern
Frequency=5.25 GHz

DUAL BAND ANTENNA WITH BENDING STRUCTURE

FIELD OF THE INVENTION

The present invention relates to an antenna, and in particular to a dual band antenna having a bending structure which is adapted for a wireless communication device.

BACKGROUND OF THE INVENTION

There is a growing need for dual band antennas for use in wireless communication devices to adapt the devices for dual band operation. For example, the transition of application frequency from 2.45 GHz (IEEE802.11b) to 5.25 GHz (IEEE802.11a) requires an antenna which operates at both frequencies, rather than two single band antennas. Referring to FIG. 7, Finnish patent application FI-982366 discloses a planar inverted-F antenna (PIFA) radiating element 600 defining a non-conductive slot 601-602-603 which divides the planar radiating element into a first branch located within a second branch. A feed point 604 and a ground contact 605 are located close to the inner end of the slot. The first branch and the second branch constitute two adjacent PIFA radiating elements on one and the same planar surface and in the vicinity of one and the same ground plane 606. The patent application also discloses that the first branch is the higher frequency element, and the second branch is the lower frequency element.

However, this substantially planar structure make the dual band antenna unsuitable for installation in a space having an irregular shape, such as is found in a laptop computer.

Hence, an improved antenna is desired to overcome the above-mentioned shortcomings of existing antennas.

BRIEF SUMMARY OF THE INVENTION

A primary object, therefore, of the present invention is to provide an improved dual band antenna with a bending structure and reduced dimensions which is adapted to fit in a space having an irregular shape.

A dual band antenna in accordance with the present invention comprises a ground patch having a connecting portion and a bending portion, a first radiating branch transversely extending from the connecting portion, and a second radiating branch partly surrounding the first radiating branch and including a connecting patch extending from the connecting portion and a radiating patch extending from the connecting patch. The connecting portion, the first radiating branch and the connecting patch are located in a same first plane. The bending portion and the radiating patch are respectively in separate planes making predetermined angles with the first plane to form a bending structure adapted for an irregular installation space in an electronic device.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
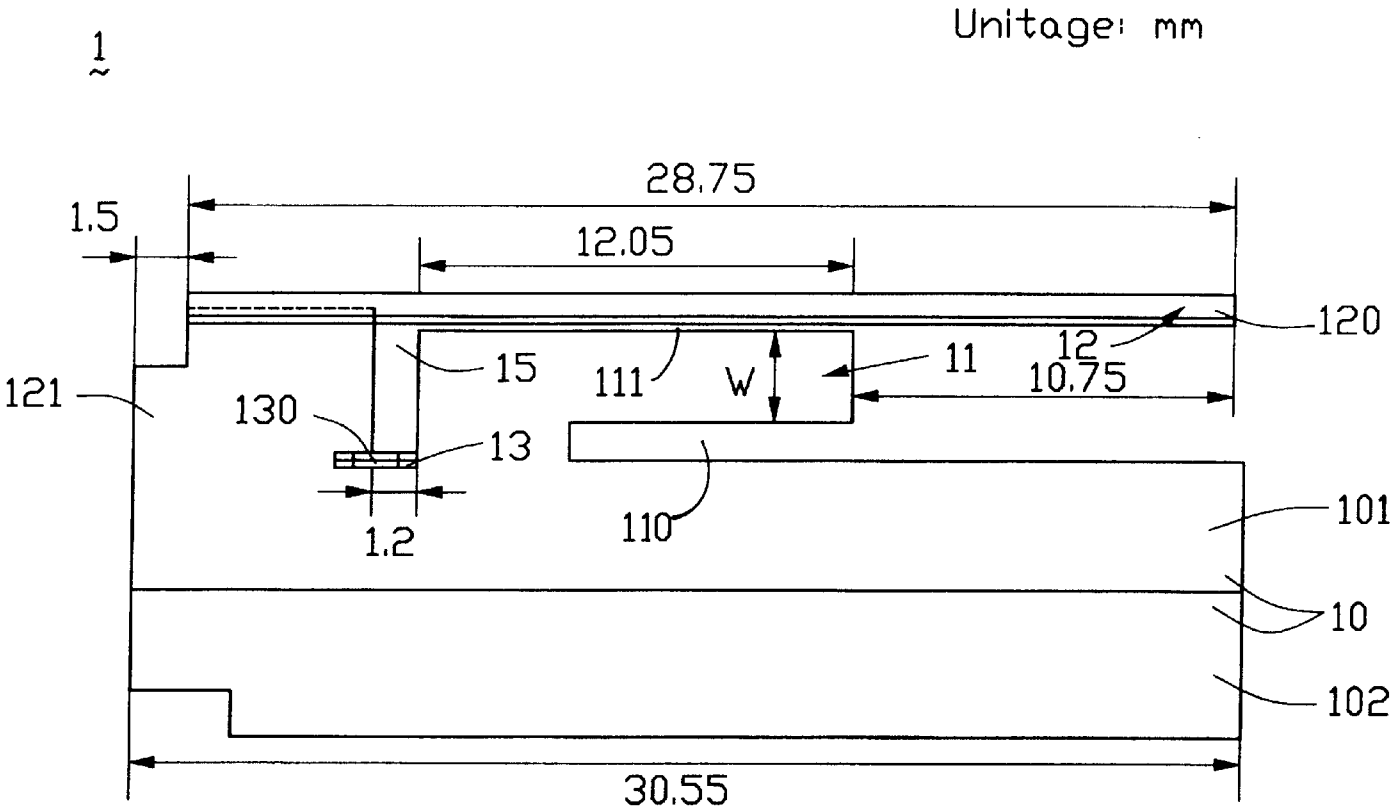
FIG. 1 is a frontal view of a preferred embodiment of a dual band antenna in accordance with the present invention without a coaxial cable.
Figure 2:
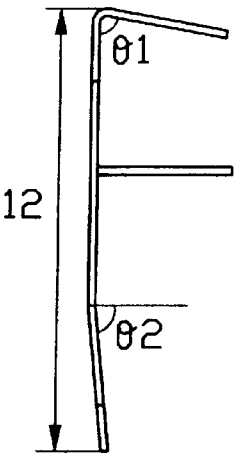
FIG. 2 is a side view FIG. 1, illustrating dimensions of the dual band antenna of FIG. 1.
Figure 3:
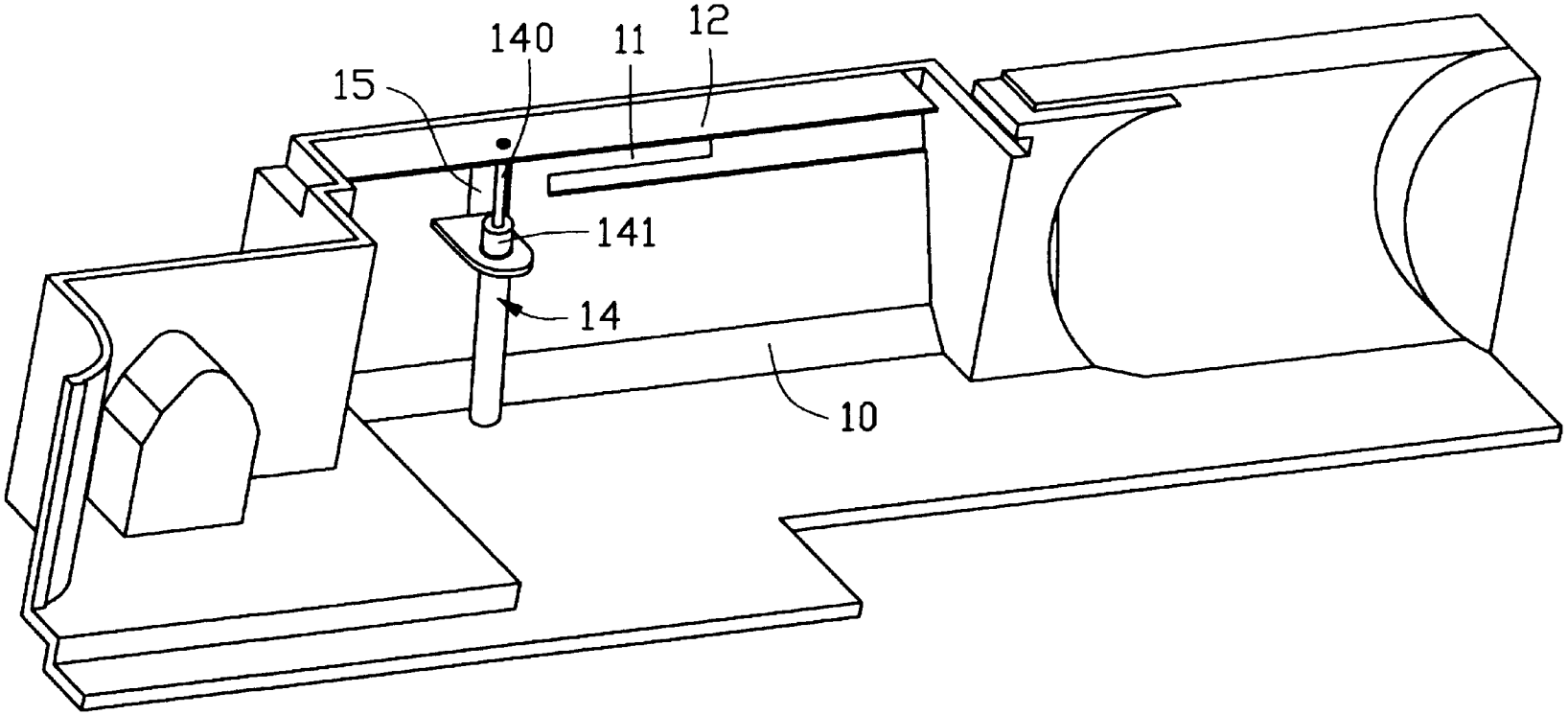
FIG. 3 is a perspective view of the dual band antenna of FIG. 1 assembled with a coaxial cable and installed in an electronic device.

Referring to FIGS. 1, 2 and 3, a dual band antenna in accordance with the present invention comprises an antenna body 1 and a coaxial feeder cable 14 electrically connected to the antenna body 1.

The antenna body 1 is made from a metal foil and includes a first radiating branch 11, a second radiating branch 12 and a ground patch 10. The ground patch 10 has a connecting portion 101 and a bending portion 102. The first radiating branch 11 operates at a predetermined first frequency and is a planar inverted-F antenna (PIFA). The first radiating branch 11 extends transversely from the connecting portion 101 and bends longitudinally to extend parallel to the connecting portion 101 with a slot 110 therebetween. The second radiating branch 12 operates at a predetermined second frequency and includes a connecting patch 121 extending transversely from the connecting portion 101 and a radiating patch 120 extending longitudinally from the connecting patch 121. The radiating patch 120 is also parallel to the connecting portion 101 and the first radiating branch 11 with a slot 111 therebetween, but is in a different plane. The first radiating branch 11 is partly surrounded by the second radiating branch 12, with a transverse L-shape slot 15 defined between the first radiating branch 11 and the second radiating branch 12. A solder tab 13 connects to the connecting portion 101 at a lower end of the slot 15 and is perpendicular to the connecting portion 101. A hole 130 is defined in the solder tab 13. The connecting portion 101, the first radiating branch 11 and the connecting patch 121 are located in a same first plane. The radiating patch 120 and the bending portion 102 are located in separate second and third planes, the second plane of the radiating patch 120 making an angle of $\theta 1$ with the first plane, and the third plane of the bending portion 102 making an angle of $\theta 2$ with a line normal to the first plane.

The coaxial feeder cable 14 comprises a conductive inner core 140, a dielectric layer (not labeled) and a conductive braiding layer 141 over the dielectric layer.

A thickness of the metal foil is 2 mm. Other detailed dimensions of the dual band antenna are shown in FIGS. 1 and 2.

In assembly, particularly referring to FIG. 3, the coaxial cable 14 is held by the solder tab 13, and passes through the hole 130. The inner core 140 is soldered to the radiating patch 120 and the braiding layer 141 is soldered to the solder tab 13. The dual band antenna as shown in FIG. 3 is assembled in a speaker box of a laptop computer (not labeled), with the bending structure of the dual band antenna fitted into the contours of an irregular space in the speaker box.

In use, RF signals are fed to the dual band antenna by the conductive inner core 140 of the coaxial cable 14 and the conductive braiding layer 141. The conductive braiding layer 141 is connected to ground via its soldered connection to the solder tab 13, which electrically connects to the ground patch 10 which is grounded. The first radiating branch 11 constitutes a high-frequency resonant structure, operating around 5.25 GHz. The second radiating branch 12 constitutes a low-frequency resonant structure, operating around 2.45 GHz. The first and second radiating branches 11, 12 constitute nearly independent regions having different resonant frequencies. This is an advantage where the antenna must operate in different environments.

The angles θ1 and θ2 and dimensions of the antenna can be changed to fit the contours and size of the space available for installation. Changes in dimensions and angles θ1 and θ2 change the radiation patterns of the antenna, allowing a designer to choose dimensions and angles θ1 and θ2 to fit a given requirement.

In particular, a width W of the first radiating branch 11 affects the bandwidth of the high-frequency band. A wider first radiating branch will yield a wider bandwidth. A gap distance between the radiating patch 120 and the bending portion 102 affects the bandwidth of the low-frequency band. A longer gap provides a broader bandwidth.

Figure 4:
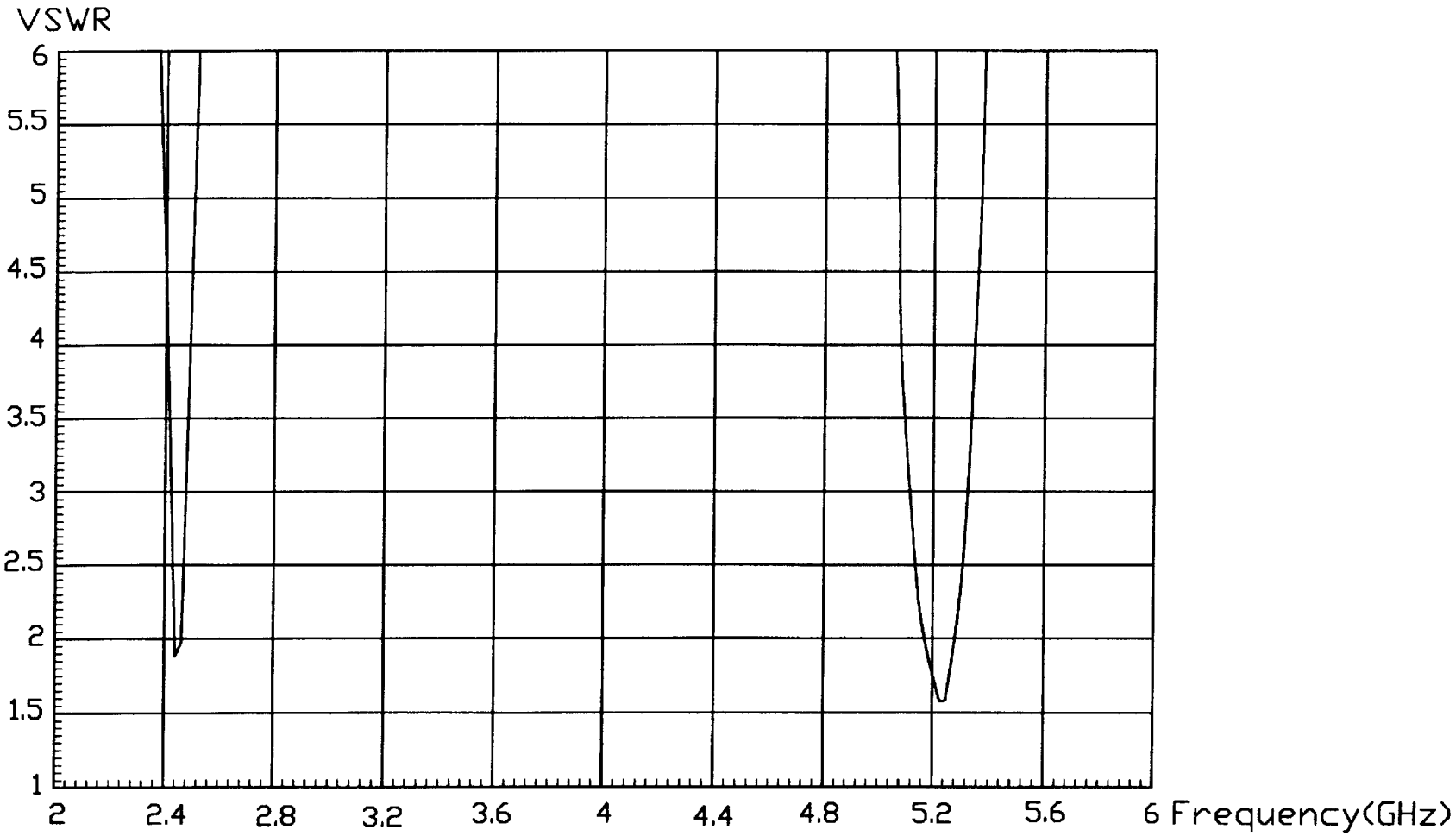
FIG. 4 is a test chart recording for the dual band antenna of FIG. 1, showing Voltage Standing Wave Ratios (VSWR) as a function of frequency.

FIG. 4 shows a test chart recording of Voltage Standing Wave Ratios (VSWR) of the dual band antenna as a function of frequency. Note that VSWR drops below the desirable maximum value "2" in the 2.45 GHz frequency band and in the 5.25 GHz frequency band, indicating acceptably efficient operation in these two frequency bands. The location of the solder point of the inner core 140 on the radiating patch 120 can be varied between a side and central areas to achieve the optimal VSWR for both bands.

Figure 5:
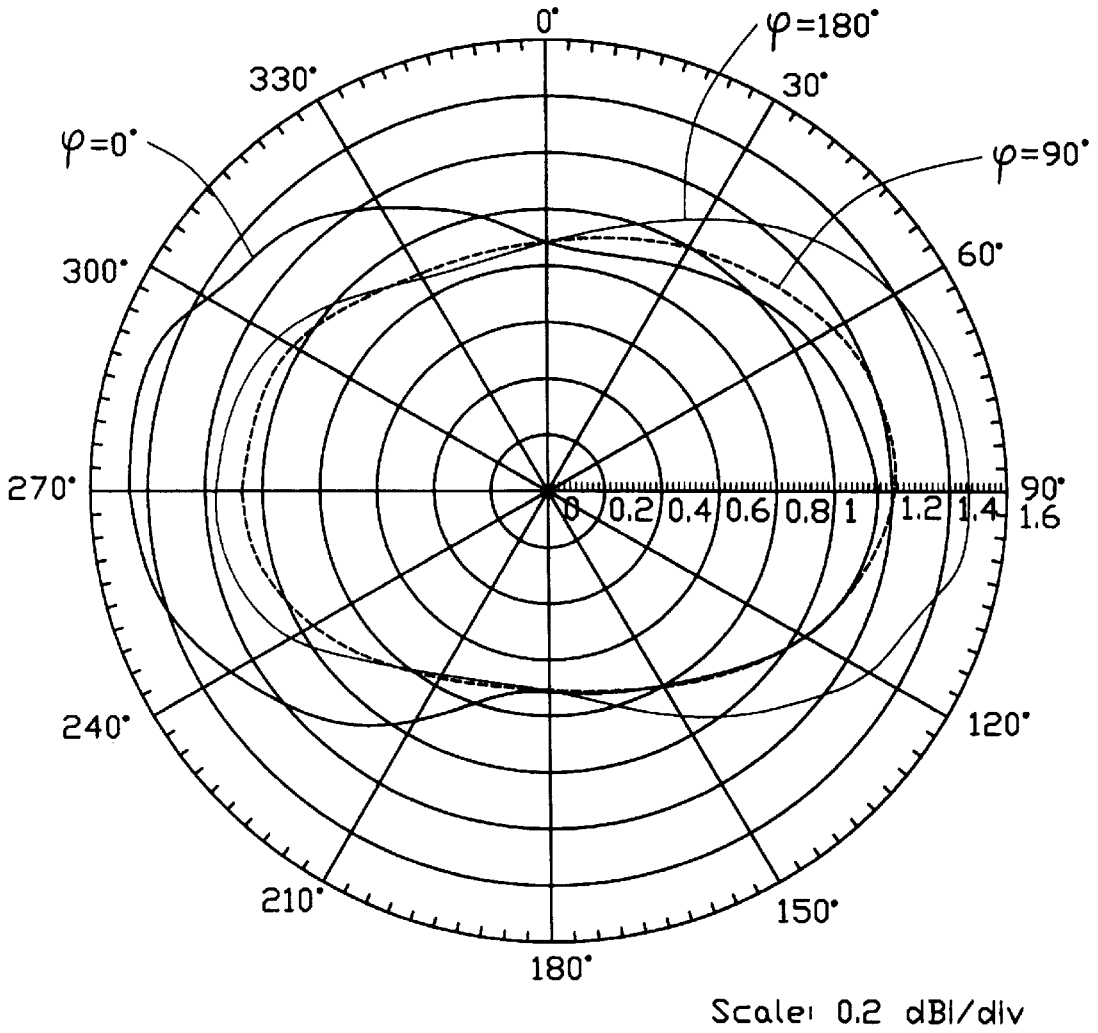
FIG. 5 is an illustration of horizontally polarized principle plane radiation patterns of the dual band slot antenna of FIG. 1 operating at frequency of 2.45 GHz.
Figure 6:
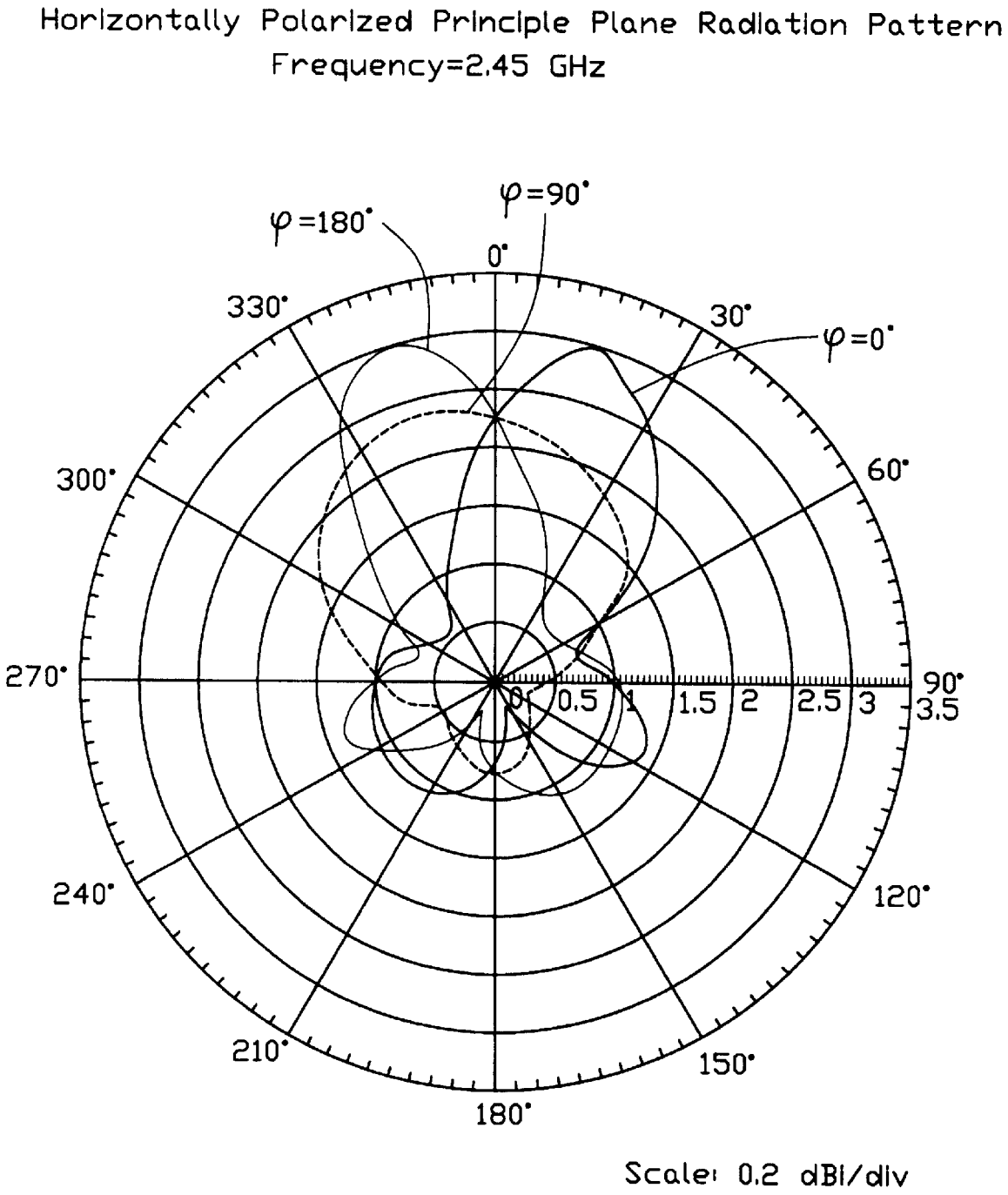
FIG. 6 is an illustration of horizontally polarized principle plane radiation patterns of the dual band slot antenna of FIG. 1 operating at frequency of 5.25 GHz.
Figure 7:
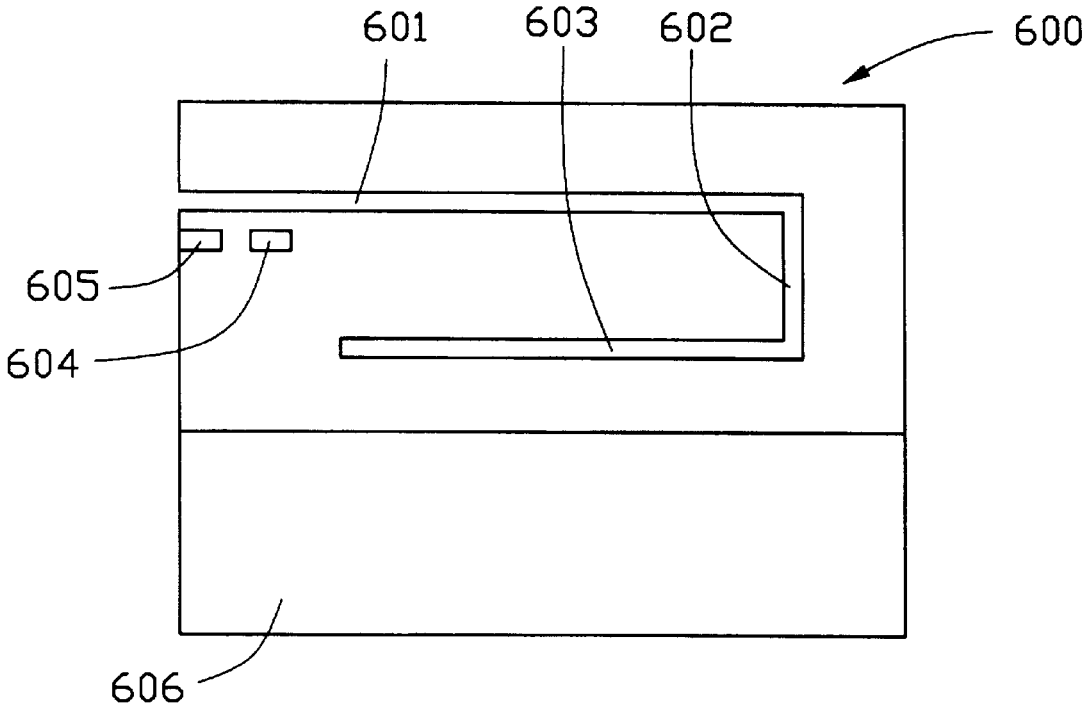
FIG. 7 (PRIOR ART)
FIG. 7 is a plane view of a conventional antenna.

FIGS. 5 and 6 respectively show horizontally polarized principle plane radiation patterns of the dual band slot antenna operating at frequencies of 2.45 GHz and 5.25 GHz.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dual band antenna for an electronic device, comprising:

a ground patch having a connecting portion in a first plane and a bending portion in a second plane, the second plane making a predetermined first angle with the first plane;

a first radiating branch extending laterally from the connecting portion for a distance and then extending longitudinally parallel to a longitudinal dimension of the connecting portion;

a second radiating branch partly surrounding the first radiating branch and including a connecting patch laterally extending from the connecting portion, and a radiating patch longitudinally extending from the connecting patch, parallel to the longitudinal dimension of the connecting portion, the radiating patch being in a third plane which make a predetermined second angle with a line normal to the first plane;

a solder tab protruding from the ground patch; and a coaxial cable feeder having a conductive inner core wire and a conductive outer shield, wherein the inner core wire is electrically connected to the radiating patch and the outer shield is electrically connected to the ground patch by soldering to the solder tab.

2. The dual band antenna as claimed in claim 1, wherein a transverse L-shape slot is defined between the first radiating branch and the second radiating branch.

3. The dual band antenna as claimed in claim 1, wherein the connecting portion, the first radiating branch and the connecting patch are all located in the first plane.

4. The dual band antenna as claimed in claim 1, wherein the first radiating branch is a planar inverted-F antenna (PIFA) and operates at a predetermined first frequency, and the second radiating branch operates at a predetermined second frequency.

5. The dual band antenna as claimed in claim 1, wherein a hole is defined in the solder tab, and the coaxial cable runs through the hole and is held by the solder tab.

6. A dual band antenna formed from a metal sheet, comprising:

a ground patch including a connection portion extending along a longitudinal direction and defining a first plane thereof;

a first radiating branch extending parallel to said connection portion in a coplanar manner while with a first slot therebetween;

a second radiating branch including a radiating patch extending along said longitudinal direction while defining a second plane angled with regard to said first plane.

7. The antenna as claimed in claim 6, wherein said radiating patch is located above said first radiating branch.

8. The antenna as claimed in claim 6, wherein a second slot is formed between said radiating patch and said first radiating branch.

9. The antenna as claimed in claim 8, wherein a solder tab angularly extends from said connection portion, and a coaxial cable has a braiding layer soldered to the solder tab and has an inner core soldered to the radiating branch.

10. The antenna as claimed in claim 9, wherein a third slot is formed around said solder tab, which cooperates said second slot to separate said first radiating branch and said second radiating branch.

11. The antenna as claimed in claim 10, wherein said second radiating branch includes a connecting patch located in the first plane and between said radiating patch and the connection portion.

12. The antenna as claimed in claim 11, wherein said connecting patch is coplanarily spaced from said first radiating branch with the third slot.

13. The antenna as claimed in claim 6, wherein said antenna defines a F-like side view.

14. The antenna as claimed in claim 6, wherein said ground patch further includes a bending portion under said connection portion in an angle manner.

15. A dual band antenna comprising:

a ground patch including a connection portion defining a first plane;

a first radiating branch located in said first plane;

a second radiating branch adjacent to said first radiating branch, including a radiating patch defining in a second plane angled with regard to said first plane; and a slot formed around an intersection of said first radiating branch and said radiating patch of the second radiating branch.

16. The dual band antenna as claimed in claim 15, wherein a solder tab angularly extends from said connection portion and a coaxial cable includes a outer braiding layer soldered thereon and an inner core soldered on one of said first and second radiating branches.

17. A dual band antenna comprising:

a ground patch including a coplanar connection portion defining a first plane;

a first radiating branch located in said first plane;

a second radiating branch adjacent to said first radiating branch, including a radiating patch defining in a second plane angled with regard to said first plane; and said ground patch further including a bending portion defining a third plane angled with said first plane and opposite to said second plane.

18. The antenna as claimed in claim 17, wherein a solder tab extends from the first plane and between said second and third planes where a coaxial cable is soldered.

* * * * *